United States Patent [19]

Scarpa

[11] Patent Number: 4,779,860

[45] Date of Patent: Oct. 25, 1988

[54] ALIGNING APPARATUS FOR ROTARY CARTON FEEDER

[75] Inventor: Eric W. Scarpa, Cincinnati, Ohio

[73] Assignee: R. A. Jones & Co. Inc., Covington, Ky.

[21] Appl. No.: 108,151

[22] Filed: Oct. 14, 1987

[51] Int. Cl.[4] ..... B65H 3/32

[52] U.S. Cl. ..... 271/110; 271/113; 271/117; 271/150

[58] Field of Search ..... 271/110, 111, 113, 149, 271/150, 117

[56] References Cited

U.S. PATENT DOCUMENTS

| | | | |
|---|---|---|---|
| 4,429,864 | 2/1984 | Scarpa et al. | 271/10 |
| 4,511,134 | 4/1985 | Hughes | 271/113 |
| 4,582,315 | 4/1986 | Scarpa | 271/150 |
| 4,616,818 | 10/1986 | Vischer | 271/113 |

*Primary Examiner*—Richard A. Schacher

*Attorney, Agent, or Firm*—Wood, Herron & Evans

[57] ABSTRACT

A cartoner has a generally horizontal magazine and a rotary feeder at the discharge end of the magazine, the rotary feeder having a knife that is generally parallel to the plane of the cartons to slice the cartons one at a time from the stack in the magazine. A mechanism is provided for pivoting the plane of the slicing blade to follow the plane of the upper edges of the cartons in the event that the cartons become twisted in the magazine.

2 Claims, 1 Drawing Sheet

ALIGNING APPARATUS FOR ROTARY CARTON FEEDER

This invention relates to a feeder of carton blanks in a cartoner and more particularly the invention relates to an improvement in the rotating feeder of U.S. Pat. No. 4,429,864.

A cartoner is a machine that receives flat folded cartons from a magazine, transfers the cartons from the magazine to transport lugs of a carton conveyor, and loads the cartons with the product to be inserted into the cartons. The present invention relates to the feeder that transfers the cartons from the magazine to the transport lugs of the transport conveyor.

The specific feeder is the rotary feeder of U.S. Pat. No. 4,429,864. That feeder is located at the discharge end of a generally horizontally-oriented magazine and it picks off cartons one at a time from the magazine to deliver them to mechanism that erects them and disposes them between the transport lugs of a transport conveyor.

The rotary feeder has a knife whose leading edge lies in a plane parallel to the plane of the leading carton blank. The leading edge slices between the leading carton and the carton immediately adjacent to it to begin to pull that leading carton away from the stack. Generally helical surfaces on the rotary feeder capture the upper edge of the leading carton and swing it away from the stack as the feeder rotates. The upper edge is thereafter released and blown downwardly to a horizontal position where it is conveyed through erecting mechanism and captured by transport lugs.

The rotary feeder is used for various size blanks, including large blanks such as those used to form cereal boxes. Such large blanks will, for a variety of reasons, tend to become twisted slightly in the magazine. While the bottom edge of the leading carton might lie parallel to the plane of the knife edge, the twist causes the upper edge to be out of parallel. The consequence of being out of parallel is that the knife edge might miss the carton altogether or, alternatively, might tend to bite into the carton upstream of the leading carton.

Attempts have been made to solve the problem of alignment by applying various forms of pressure to the upper edges of the cartons. These attempts have not proved completely reliable.

The objective of the present invention has been to solve the problem of misalignment of the cartons with the rotary feeder.

The objective of the present invention has been attained by aligning the feeder with the upper edges of the cartons rather than attempting to align the upper edges of the carton with the feeder. More specifically, the rotary knife and the mechanism that drives it are mounted on a pivotal axis that passes through the normal plane of the leading carton in the magazine. A servo mechanism is connected to the mount to rotate the knife about that pivotal axis. A photocell is directed on the spot where the upper edge of the leading carton should occupy for proper feeder operation. It controls the servomotor which operates to pivot the blade in one direction when the upper edge has twisted away from the knife and in the opposite direction when the upper edge has twisted too far underneath the knife.

The several features and objectives of the present invention will become more readily apparent from the following detailed description taken in conjunction with the accompanying drawings in which.

Figure 1:
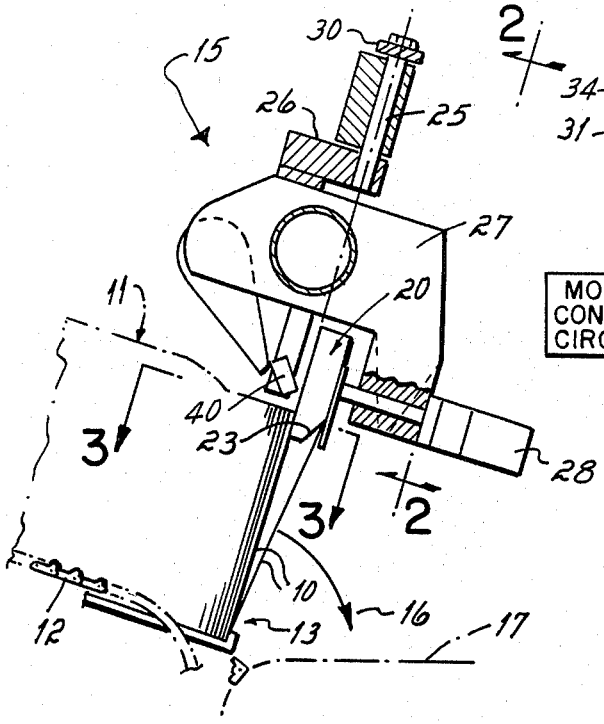
FIG. 1 is a side elevational view partly in section of the feeder mechanism.
Figure 2:
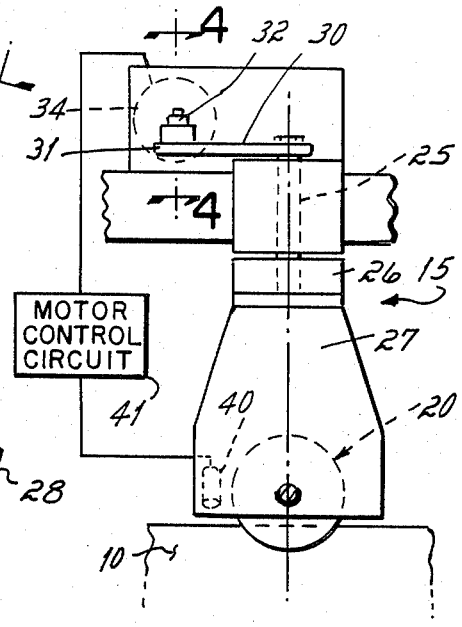
FIG. 2 is a cross-sectional view taken along lines 2—2 of FIG. 1.
Figure 3:
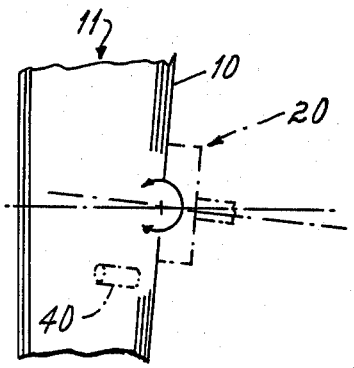
FIG. 3 is a cross-sectional view taken along lines 3—3 of FIG. 1.

Referring to the drawings, cartons 10 are disposed in a stack 11 having a generally vertical orientation although slightly inclined. The cartons are mounted on conveyor chains 12 that advance them forward toward a discharge end 13 as needed. Overlying the discharge end of the magazine 12 is a feeder mechanism 15 whose function is to strip the leading cartons, one at a time, from the stack and deliver them into a horizontal attitude as indicated by the arrow 16 onto a conveyor 17 that delivers the cartons into transport lugs of the cartoner.

Figure 5:
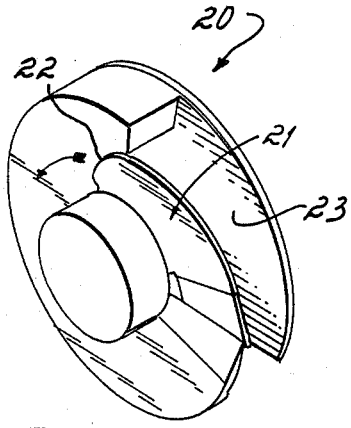
FIG. 5 is a perspective view of a feeder wheel forming the key element of the feeder mechanism.

The feeder includes a wheel 20 having a knife blade 21 facing in an upstream direction, the knife blade having a generally planar leading edge portion 22 (FIG. 5). A generally helical surface 23 behind the leading edge 22 is provided to capture the upper edge of a carton, to peel it away from the stack, and to flip it downwardly toward the conveyor 17.

The leading edge portion 22 of the knife blade 21 is normally generally parallel to a line running through the upper edge of the leading carton 10. When that relationship is maintained, the knife edge slices between the leading carton and the immediately adjacent carton, thereby separating the leading carton from the immediately adjacent carton.

When the cartons in the magazine twist so that even though the lower edges might be in a proper parallel orientation with respect to the knife edge, the upper edges are twisted with respect to the knife edge. In that orientation, the knife edge cannot make a clean pass between the two cartons. It may miss or strike the leading carton, or it may strike the trailing carton. In either event, undesirable feeding results.

To solve that problem, the feeder mechanism has been mounted on a pivot shaft 25. The axis of that pivot shaft preferably passes through the plane of the knife edge portion 22. The structure that is pivoted on the shaft 25 consists of a bracket 26, a blower housing 27 that blows the released leading carton down onto the conveyor 17 and a gearbox 28 that rotates the rotating feeder 20 in synchronism with the cartoner.

Figure 4:
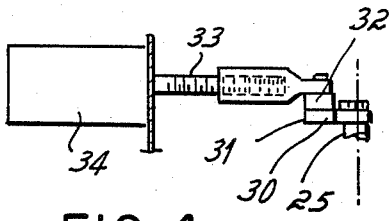
FIG. 4 is a cross-sectional view taken along lines 4—4 of FIG. 2.

An arm 30 is fixed to the pivot shaft 25 and has its end 31 connected by a pin 32 to a screw (FIG. 4) 33 of a servomotor 34 mounted on the frame of the cartoner. When the servomotor is energized, it rotates the screw 33 causing the arm 30 to swing and hence causing the feeder assembly to pivot about the shaft 25.

A photoelectric cell 40 is mounted on the housing 27 and is carried with it. It is directed to the upper edge of the leading carton 10. It is connected through a motor control circuit 41 to the servomotor 34 to cause the continuous operation of the servomotor 34 in the desired direction.

The function of the photoelectric cell 40 and servomotor is to maintain the knife edge in the proper orientation with respect to the leading carton 10. If the cartons twist in one direction so they move out of the beam of the photoelectric cell, the servomotor will rotate in one direction to pivot the assembly so as to bring the plane of the knife edge back into parallelism with the upper edge of the cartons. If the sensor sees dark, that is, a supply of cartons underneath, then the servomotor is caused to operate in the opposite direction. In the system described, the servomotor is constantly operating back and forth to adjust to the position of the upper edge for the leading carton so that, effectively, the plane of the leading edge 22 of the knife 21 is always parallel to the upper edge of the leading carton and will always take a proper pass to slice the leading carton away from the stack.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A carton feeder comprising:

a magazine having a discharge end and a generally horizontal conveyor for conveying flat folded cartons in a generally vertical attitude to said discharge end, a rotary metering blade having an approximately planar leading edge portion at the discharge end of said magazine, said planar edge portion normally being parallel to the upper edges of said cartons, means for rotating said blade to slice, one at a time, cartons from said magazine, means for mounting said metering blade and rotating means on a pivot axis parallel to the planar edge portion of said metering blade, means for monitoring the angular relationship of the upper edges of said cartons relative to said metering blade, and means responding to said monitoring means for pivoting said metering blade to maintain a substantially parallel relationship between the leading edge portion of said blade and the upper edge of the leading carton.

2. A carton feeder as in claim 1 in which said pivoting means comprises a servomotor connected to said means for mounting said rotary blade to pivot said blade in both directions about said pivot axis, said means for monitoring comprising a photocell having a beam focused on the point at which the upper edge of a leading carton in said magazine is parallel to said planar blade edge, and control means causing said servomotor to rotate in one direction when said leading edge is away from said photocell and in the opposite direction when said leading edge is under said photocell beam.

* * * * *